US010161676B2

(12) United States Patent
Zapp et al.

(10) Patent No.: US 10,161,676 B2
(45) Date of Patent: Dec. 25, 2018

(54) PROCESS AND APPARATUS FOR THE LOW-TEMPERATURE FRACTIONATION OF AIR

(71) Applicant: LINDE AKTIENGESELLSCHAFT, Munich (DE)

(72) Inventors: Gerhard Zapp, Pullach (DE); Michael Siebel, Geretsried (DE)

(73) Assignee: Linde Aktiengesellschaft, Munich (DE)

( * ) Notice: Subject to any disclaimer, the term of this patent is extended or adjusted under 35 U.S.C. 154(b) by 93 days.

(21) Appl. No.: 15/303,145

(22) PCT Filed: Apr. 15, 2015

(86) PCT No.: PCT/EP2015/000790
§ 371 (c)(1),
(2) Date: Oct. 10, 2016

(87) PCT Pub. No.: WO2015/158431
PCT Pub. Date: Oct. 22, 2015

(65) Prior Publication Data

US 2017/0038140 A1 Feb. 9, 2017

(30) Foreign Application Priority Data

Apr. 15, 2014 (EP) ..... 14001373

(51) Int. Cl.
*F25J 3/04* (2006.01)
*G05B 13/04* (2006.01)

(52) U.S. Cl.
CPC ..... *F25J 3/04848* (2013.01); *F25J 3/044* (2013.01); *F25J 3/04054* (2013.01)

(58) Field of Classification Search
CPC ..... F25J 3/04; F25J 3/04006; F25J 3/04012; F25J 3/04018; F25J 3/04024; F25J 3/04048; F25J 3/04848; F25J 3/04812; F25J 3/0483; F25J 3/04151; F25J 3/044; F25J 1/0012; F25J 1/0015; F25J 1/0017; F25J 1/002; F25J 2230/04; F25J 2230/30; F25J 2230/40; F25J 2280/02; F25J 2280/50; G05B 13/042
See application file for complete search history.

(56) References Cited

U.S. PATENT DOCUMENTS

2002/0017113 A1 2/2002 Seiver et al.
2007/0038333 A1* 2/2007 Dadebo ..... B01D 3/4211 700/270

(Continued)

*Primary Examiner* — Frantz Jules
*Assistant Examiner* — Erik Mendoza-Wilkenfe
(74) *Attorney, Agent, or Firm* — Philip H. Von Neida

(57) ABSTRACT

The process and the apparatus serve for the low-temperature fractionation of air in a distillation column system, which has at least one separating column. Feed air is compressed in a main air compressor. Compressed feed air is cooled in a main heat exchanger. Cooled feed air is introduced into the distillation column system. At least one product stream is drawn off from the distillation column system, heated in the main heat exchanger and drawn off as a gaseous end product. At least one process parameter is set by a basic controller. The control of the process parameter is set by a combination of an ALC control and an MPC controller. This involves the ALC control outputting a first target value to the MPC controller.

5 Claims, 3 Drawing Sheets

(56) References Cited

U.S. PATENT DOCUMENTS

| | | | | |
|---|---|---|---|---|
| 2008/0047298 | A1* | 2/2008 | Corduan | F25J 3/0409 62/643 |
| 2008/0243310 | A1* | 10/2008 | Esposito | G05B 13/042 700/268 |
| 2010/0211221 | A1* | 8/2010 | Rauch | F25J 3/04303 700/275 |

* cited by examiner

PROCESS AND APPARATUS FOR THE LOW-TEMPERATURE FRACTIONATION OF AIR

CROSS-REFERENCE TO RELATED APPLICATIONS

This application claims priority under 35 USC § 119 to International Patent Application No. PCT/EP2015/000790 filed on Apr. 4, 2015 which claims priority from European Patent Application EP 14001373.1 filed on Apr. 4, 2014.

BACKGROUND OF THE INVENTION

The invention relates to a process for the low-temperature fractionation of air in a distillation column system that has at least one separating column, in which feed air is compressed in a main air compressor, compressed feed air is cooled down in a main heat exchanger, cooled-down feed air is introduced into the distillation column system and at least one product stream is drawn from the distillation column system, warmed up in the main heat exchanger and drawn off as a gaseous end product, wherein at least one process parameter is set by a basic controller, especially the closed-loop control of such a process, in particular during variable operation.

Processes and apparatuses for the low-temperature fractionation of air are known for example from Hausen/Linde, Tieftemperaturtechnik [cryogenics], 2nd edition 1985, Chapter 4 (pages 281 to 337).

The distillation column system of the invention may be formed as a one-column system for nitrogen-oxygen separation, as a two-column system (for example as a classic Linde double-column system), or as a three- or multi-column system. In addition to the columns for nitrogen-oxygen separation, it may have further apparatuses for obtaining high-purity products and/or other air components, in particular noble gases, for example argon production and/or krypton-xenon production.

The "main heat exchanger system" serves for cooling feed air in indirect heat exchange with return streams from the distillation column system. It may be formed by a single or a number of heat exchanger portions connected in parallel and/or in series, for example by one or more plate heat exchanger blocks.

Low-temperature air fractionation systems make high demands on the overall process control, both in terms of the type of system and in terms of the requirements with respect to capabilities under changing loads and optimizations of yield. They are characterized by an intensive intercoupling of the individual columns and apparatuses by heat and material balances. From a control engineering perspective, they represent a highly intercoupled multi-variable system. Moreover, the setpoint values of the variables to be controlled (analyses, temperatures, etc.) are dependent on the respective load case. On the other hand, for example, systems for producing gaseous products must quickly keep production in step with customer demand, and nevertheless at the same time ensure the highest possible product yield (in particular of oxygen and/or argon).

A "basic controller" controls a process parameter to a specified setpoint value. Such a "process parameter" is formed by a physical variable that has an influence on the fractionation process, for example by the pressure, the temperature or the throughflow at a specific point of the system or in a specific process step (PIC—pressure indication control, TIC—temperature indication control, FIC—flow indication control).

The "basic controller" may be a P controller (proportional), a PI controller (proportional integral), a PD controller (proportional derivative) or a PID controller (proportional integral derivative). Alternatively, two or more such controllers may be connected to one another as a cascade controller and be used as a basic controller. The entirety of the basic controllers is realized together with the necessary interlocking and logic circuits on a "control system".

An "ALC control" (ALC=automatic load change) operates a level higher and specifies setpoint values for one or more basic controllers, preferably for the complete system, that is to say for all of the basic controllers. It is thereby possible to change automatically between the different load cases of a low-temperature air fractionation system. This technique is based on an interpolation between a number of load cases set and recorded in trial operation. In order to adopt a new load case, the target setpoint values of the individual basic controllers of the control system are precalculated and then adopted by means of a synchronized ramp, that is to say adjusted in small temporal increments within a specified time period.

The ALC control therefore specifies to the basic controllers a tested path to the load case that is to be achieved. As a result, a very high rate of adjustment is obtained. Any closed-loop control takes place in the basic control, for example by cascade controllers. Specifically, so-called trimming controllers on the control system are used, a basic controller setpoint value (mean value) that is precalculated by the ALC being corrected by a cascade circuit. The setpoint value of the cascade controller may likewise be specified by the ALC.

The various load cases of a low-temperature air fractionation system differ from one another in one or more of the following parameters:

amount of product of one or more product streams ratio of amount of liquid product to amount of gas product The recording of the load cases for the ALC control is generally performed during the commissioning of the system over the entire operating range. In this case, the corresponding load cases are manually adopted and tested. These cases are stored in a mathematical model in the ALC; the various transitions between load cases can be subsequently tested.

An alternative to ALC controls are "MPC controllers" (MPC—model predictive control). This technology is widely used in the industry for controlling difficult and intercoupled multi-variable controlled systems. The basis is a mathematical model, which depicts the variation over time of controlled variables (CV) in response to changes of manipulated variables (MV). It is customary in control engineering to use simple linear models of the first order with dead time. Alternatively, more complicated, for example non-linear, models may also be used. The entire process is described by many such models in a matrix presentation. This process model is used for the closed-loop control, in that the behavior of the system in the future is simulated and finally the variation over time of the manipulated variables is calculated such that the system deviations are minimized and limit variables (LV) are maintained. An MPC controller allows account to be taken of the mutual interrelationships, and thereby makes particularly stable operation possible.

MPC controllers can control a low-temperature air fractionation system well in steady-state operation. Load changes mean for the MPC controller the specification of new target setpoint values for measurable production amounts, and the MPC then adjusts the entire process to the new load case. The course taken in the load change and the duration are not predictable; they are usually much slower than in the case of an ALC and often very unsmooth. There is no mechanism for specifying setpoint values load-dependently.

An ALC control allows rapid load changes and at the same time keeps the process much more stable than an MPC controller by simultaneous (synchronous) adjustment of all the relevant basic controllers under its control. On the other hand, however, the advantages of multi-variable control are not enjoyed.

MPC and ALC are both techniques of sophisticated process control that operate on the basis of setpoint values of the basic controllers under their control in order to adapt production and to control measured values (analyses, temperatures). They have so far been generally regarded as mutually exclusive control technologies.

Air fractionation systems with MPC controllers are known from EP 1542102 A1 and "Air Separation Control Technology", David R. Vinson, Computers and Chemical Engineering, 2006.

The invention is based on the object of providing a process of the type mentioned at the beginning and a corresponding apparatus that make both particularly stable operation and rapid load changing possible.

This object is achieved by a process for the low-temperature fractionation of air in a distillation column system that has at least one separating column, in which

- feed air is compressed in a main air compressor.
- compressed feed air is cooled down in a main heat exchanger,
- cooled-down feed air is introduced into the distillation column system and
- at least one product stream is drawn from the distillation column system, warmed up in the main heat exchanger and drawn off as a gaseous end product,
- wherein at least one process parameter is set by a basic controller, characterized in that
- the control of the process parameter is performed by a combination of an ALC control and an MPC controller,
- wherein the ALC control contains a set of measured values of the parameter that have been recorded during trial operation of the system and correspond to the various load cases and the transitions between these load cases, wherein also
- the ALC control outputs a first target value to the MPC controller,
- the MPC controller calculates from the first target value a setpoint value or a change in the setpoint value for a primary setpoint value output by the ALC control, and
- the setpoint value determined by the MPC controller or a secondary setpoint value that is calculated from the primary setpoint value output by the ALC control and the change in the setpoint value is transferred to the basic controller.

SUMMARY OF THE INVENTION

The essence of the invention is a combination of ALC control and an MPC controller, in which the ALC control and the MPC controller work together for at least one of the process parameters of the low-temperature air fractionation system. In this case, at least one setpoint or target value determined by the ALC control is not transmitted as usual directly to a basic controller of a first process parameter, but instead is additionally influenced by the MPC controller and only then passed on to the basic controller.

In a first variant of the invention, the ALC control outputs a first target value to the MPC controller, the MPC controller calculates from the first target value a setpoint value for the first process parameter and passes this on to the basic controller. Further process parameters are calculated by the MPC in order to minimize the disruption of the process by the first process parameter. The same principle may be applied for further process parameters.

In a second variant of the invention, the ALC control outputs both a first target value and a primary setpoint value for the process parameter. On the basis of the first target value, the MPC controller calculates a change in the setpoint value for the primary setpoint value output by the ALC control, and the correspondingly changed (trimmed) setpoint value ("secondary setpoint value") is transferred to the basic controller for the first process parameter. The same principle may be applied for further process parameters.

The two variants of the invention may also be combined, in that the first variant is applied to a first process parameter and the second variant is applied to another, second process parameter, in that a first and a second process parameter are set, in that

- the ALC control outputs a first and second target value to the MPC controller,
- the MPC controller calculates from the transferred target values the setpoint values for the process parameter and
- the MPC controller calculates from the second target value a change in the setpoint value for a primary setpoint value output by the ALC control for the second process parameter and
- the setpoint value determined by the MPC controller for the first process parameter and a secondary setpoint value for the second process parameter, which is calculated from the primary setpoint value output by the ALC control and the change in the setpoint value, is transferred to the basic controllers for the first process parameter and the second process parameter.

Further process parameters may be set by the ALC control alone, without the MPC controller intervening in that a third process parameter is set, in that the ALC control transfers a setpoint value to the basic controller of the third process parameter directly without inclusion of the MPC controller.

It is favorable if a multiplicity of process parameters are controlled in one of these ways, preferably all of the process parameters of the entire low-temperature air fractionation system that require such closed-loop control.

The technique described here advantageously combines an ALC control and an MPC controller, and thereby at the same time reduces the complexity of the configuration. Altogether, both particularly stable operation in the steady state and a high load changing rate in variable operation are obtained.

Depending on product requirements, with the invention the distillation column system can be guided from a first load case to a second load case. The ALC control thereby specifies in discrete time increments setpoint values for one or more basic controllers or one or more primary setpoint values for the MPC controller. This is also referred to as "ramping" of the corresponding parameters. Preferably, all of the parameters or basic controllers are ramped by the combination of ALC and MPC.

The invention also relates to an apparatus for the low-temperature fractionation of air comprising a distillation column system that has at least one separating column, a main air compressor for compressing feed air, a main heat exchanger for cooling down compressed feed air, a feed line for introducing cooled-down teed air into the distillation column system and means for drawing off a product stream from the distillation column system and for warming up the product stream drawn off in the main heat exchanger, a product line for drawing off the warmed-up product stream as a gaseous end product, and comprising at least one basic controller for setting a first process parameter, characterized by one or more open-loop and closed-loop control devices. Complex "closed-loop and open-loop control devices" are thereby used, together making at least partially automatic switching over between the two operating modes possible. They may, for example, comprise a correspondingly programmed process control system.

BRIEF DESCRIPTION OF THE DRAWINGS

The invention and further details of the invention are explained more specifically below on the basis of exemplary embodiments that are schematically represented in the drawings, in which.

DETAILED DESCRIPTION OF THE INVENTION

Figure 1:
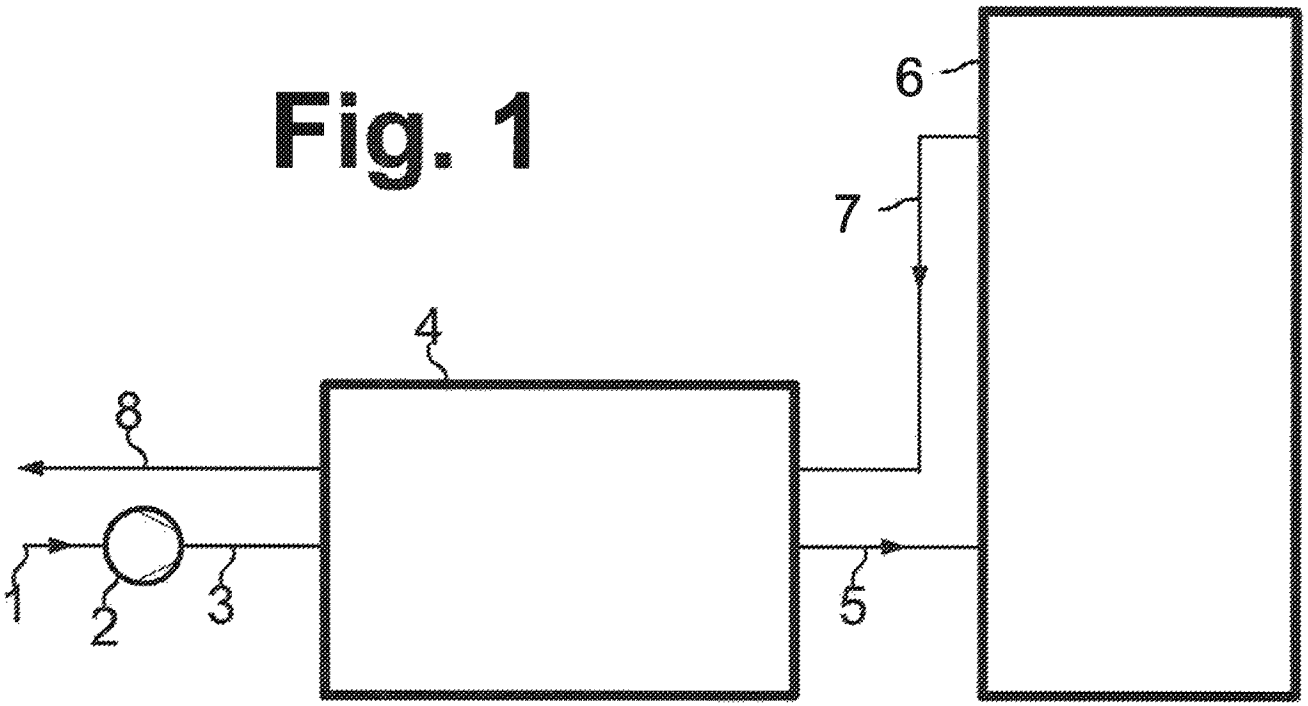
FIG. 1 is a schematic of the elements of a low-temperature air fractionation process.

In FIG. 1, feed air 1 is compressed in a main air compressor 2. The compressed feed air 3 is cooled down in a main heat exchanger 4. The cooled-down feed air 5 is introduced into a distillation column system 6. The distillation column system 6 has at least one separating column, for example a classic double column comprising a high-pressure column, a low-pressure column and a main condenser (not represented). From the distillation column system, at least one product stream 3 is drawn off, warmed up in the main heat exchanger 4 and as a gaseous end product 8.

Both exemplary embodiments of the invention relate to a system for the low-temperature fractionation of air. This system has basic controllers BR1 to BR3, which have a closed-loop control function, that is to say they set a specified setpoint value of a manipulated variable within a control loop. Further basic controllers BR4 to BR7 do not have a closed-loop control function, but set the transferred setpoint value of the corresponding manipulated variable directly and only change when there is a load change.

Figure 2:
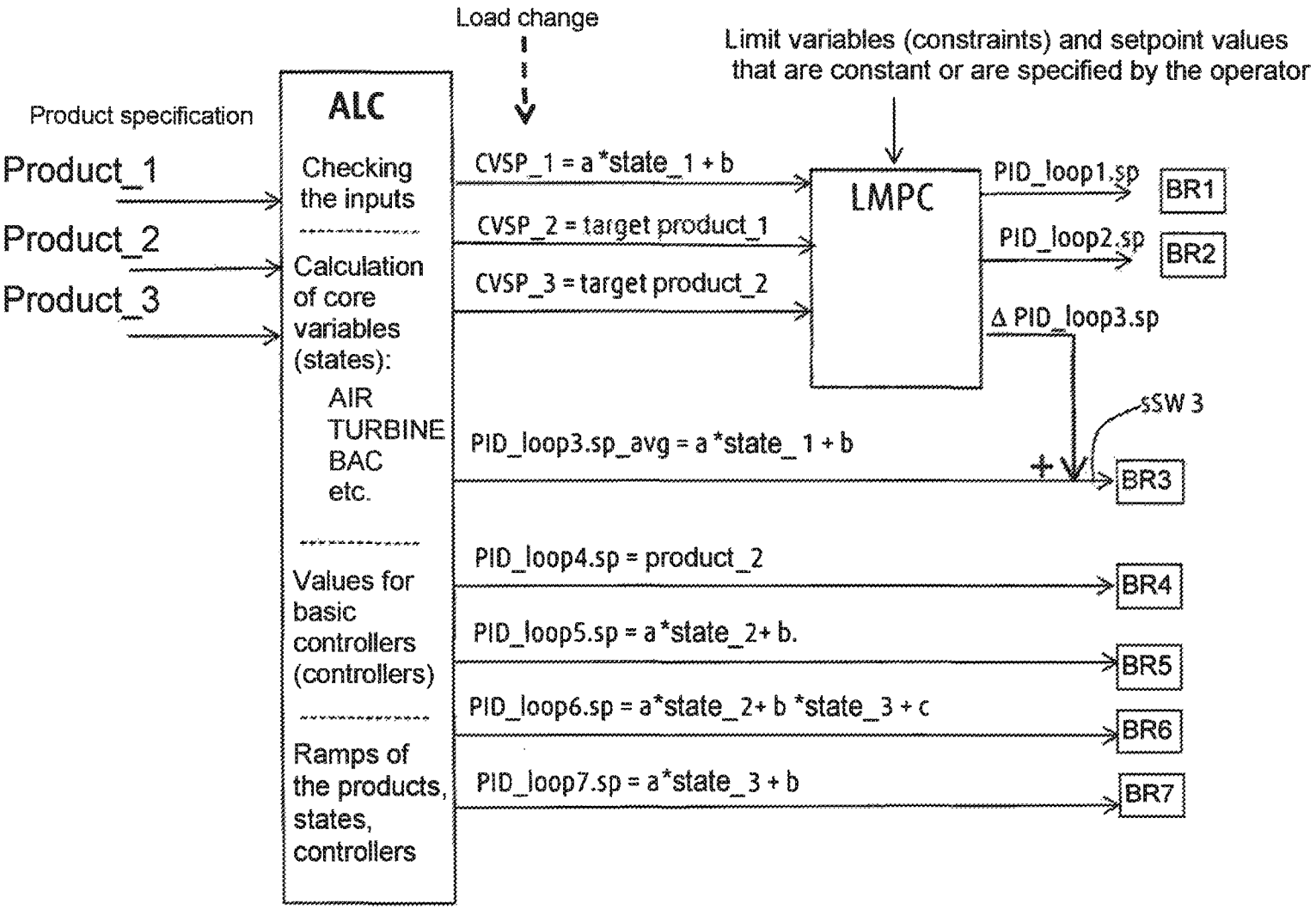
FIG. 2 shows a first exemplary embodiment of a combination of the first and second variants of the invention.

In FIG. 2, when there is a load change the changed product specifications for one or more products, for example of the gaseous oxygen product (GOX) and/or of the liquid nitrogen product (LIN), are input into the ALC. The ALC checks these inputs, calculates the core variables (states), which describe the aimed-for target state of the system, in particular the amount of air (AIR), the amount(s) to be expanded to produce work (TURBINE) and the proportion of air that is sent through a recompressor (BAC). The ALC then guides the transformation of these core variables and basic controller setpoint values on a predetermined ramp in each case from the initial state to the target state. This ramp is fixed for each parameter (core variables and basic controllers) by a relationship such as that represented in FIG. 1 under the heading "Load change".

In the case of a first part of the manipulated variables (for the basic controllers BR1 and BR2, which are shown here as representative), an MPC controller LMPC calculates from the target values CVSP_i transmitted from the ALC a respective setpoint value PID_loop1.sp, PID_loop2.sp by using a linear model. Some of the target values CVSP_i are formed by the production target values, others by setpoint values for controlled variables such as temperatures or analyses. The setpoint values PID_loop1.sp, PID_loop2.sp are output as absolute values to the corresponding basic controller BR1, BR2. This realizes the "first variant" of the invention.

For a second part of the manipulated variables (for the basic controller BR3, which is shown here as representative), the MPC controller acts as a trimming controller, which calculates a correction value ΔPID_loop3.sp. This correction value is added as a setpoint value change to the primary setpoint value PID_loop3.sp_avg calculated by the ALC and the sum is transferred as a secondary setpoint value sSW3 to the corresponding basic controller BR3. This realizes the "second variant" of the invention. Examples of corresponding setpoint variables are the return amounts for the columns of the distillation column system, parameters of gaseous products removed or streams for the production of cold or the distribution of the streams through heat exchangers.

Apart from the target values, limit variables and setpoint values that are constant or are specified by the operating personnel are possibly also entered into the calculations of the MPC controller. Examples of this are for instance product purities or energy consumptions of machines that may only vary within given limit values. In a realistic example, the MPC controller calculates for a total of around eight to ten basic controllers with a closed-loop control function absolute setpoint values or correction values.

A third part of the manipulated variables (for the basic controllers BR4 to BR7, shown here as representative), the ALC delivers the corresponding setpoint values directly in a classic way. These values are not influenced by the MPC controller. In a realistic example, the ALC delivers the setpoint values directly for a total of around 20 to 30 basic controllers without a closed-loop control function.

Figure 3:
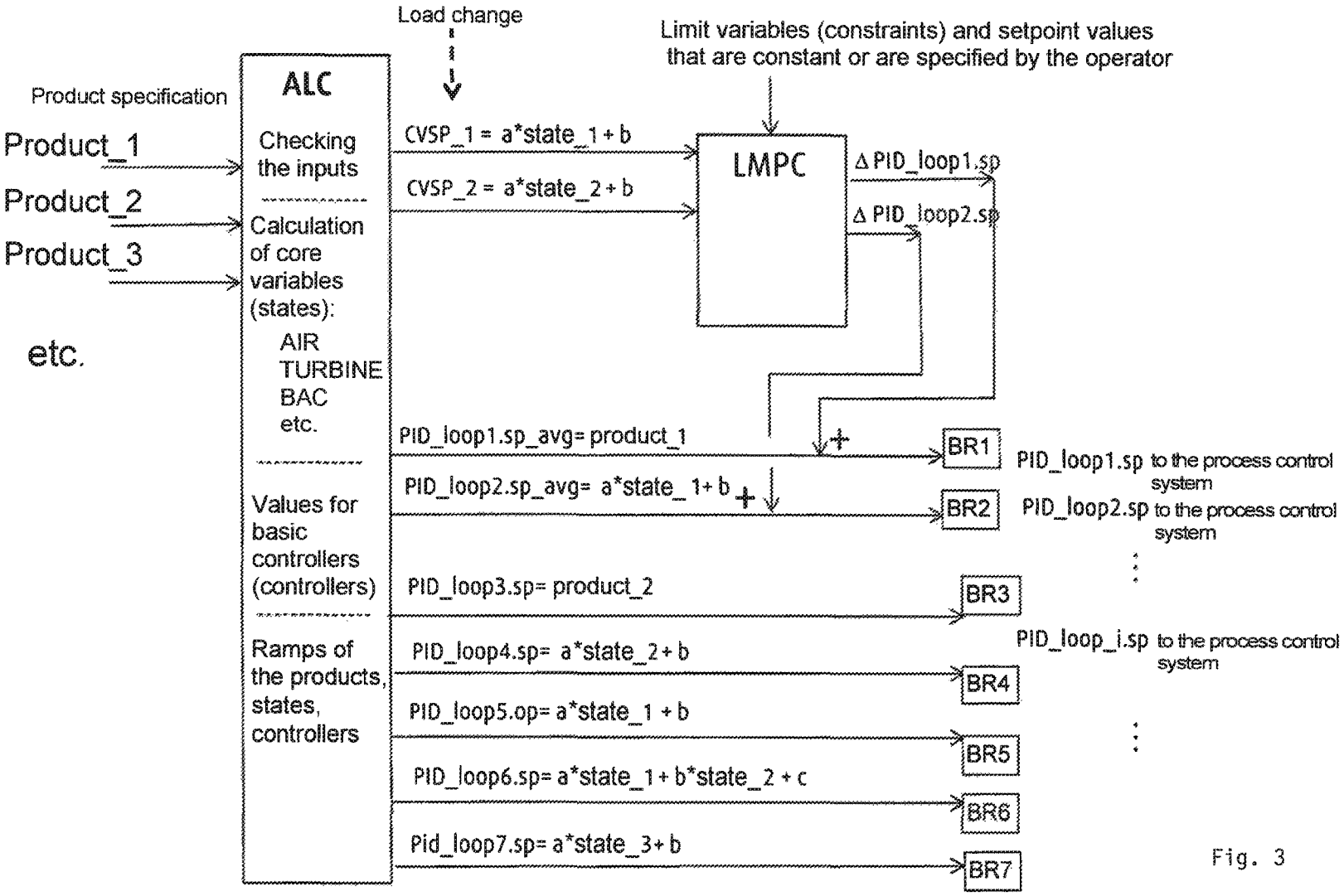
FIG. 3 shows an exemplary embodiment of the second variant of the invention.

In FIG. 3, the "second variant" of the invention is used exclusively. As a difference from FIG. 1, here the MPC controller LMPC does not calculate any absolute values for manipulated variables, but instead just operates in the manner of a trimming controller according to the second variant for a specific number of setpoint variables, of which PID_loop1.sp_avg and PID_loop2.sp_avg are shown in the drawing by way of example for the basic controllers B1, B2 with a closed-loop control function. In practice, for example, three to six manipulated variables are determined in this way.

The other manipulated variables (for the basic controllers BR3 to BR7, which are shown here as representative), the ALC delivers the corresponding setpoint values directly in a classic way. These values are not influenced by the MPC controller. In a realistic example, the ALC delivers the setpoint values directly for a total of around 20 to 30 basic controllers without a closed-loop control function.

In the case of both exemplary embodiments, usually all of the basic controllers that are driven by ALC and LMPC are incorporated in an integrated process control system. The programs for ALC and LMPC are usually run on a dedicated process computer, which exchanges the data with the process control system by way of a network connection, and thus transmits the calculated setpoint values to the inputs of the process control system.

What we claim is:

1. A process for the low-temperature fractionation of air in a distillation column system that has at least one separating column, in which feed air is compressed in a main air compressor, the compressed feed air is cooled down in a main heat exchanger and introduced into the distillation column system wherein at least one product stream is drawn from the distillation column system, the at least one product stream is warmed up in the main heat exchanger and drawn off as a gaseous end product; and wherein at least one process parameter(s) of the distillation column system is set by a basic controller, characterized in that the control of the at least one process parameter(s) set by the basic controller is performed by a combination of an Automatic Load Control (ALC) control and an Model Predictive Control (MPC) controller;

wherein the ALC control contains various load cases recorded during trial operation of the distillation column system corresponding to target values of the at least one process parameter(s) output by the basic controller as well as transitions between the various load cases;

the ALC control outputs a first target value of one of the various load cases to the MPC controller, the MPC controller capable of calculating from the first target value, both a primary set point value and a change to the primary set point value forming a changed primary set point value, in which the primary set point value and/or changed primary set point value is then sent to the basic controller as a first process parameter of the at least one process parameter(s) output by the basic controller.

2. The process as claimed in claim 1, further characterized in that the ALC control outputs a second target value of the one of the various load cases and a secondary set point value to the MPC controller which calculates a change to the secondary set point value based on the second target value to form a changed secondary set point value which is then sent to the basic controller as the second process parameter of the at least one process parameter(s) output by the basic controller.

3. The process as claimed in claim 1, wherein the ALC control transfers a tertiary set point value directly to the basic controller as a third process parameter of the at least one process parameters output by the basic controller, without inclusion of the MPC controller.

4. The process as claimed in claim 1, wherein the ALC control and the MPC controller deliver set point values for a multiplicity of process parameters.

5. The process as claimed in claim 1, wherein the distillation column system is guided from a first load case of the various load cases to a second load case of the various load cases, the ALC control thereby specifying in discrete time increments, set point values for the basic controller or for a plurality of basic controllers or one or more primary set point values for the MPC controller.

* * * * *